US005199291A

United States Patent [19]

Bahl, Jr. et al.

[11] Patent Number: 5,199,291

[45] Date of Patent: Apr. 6, 1993

[54] ROLL FORMING MACHINE WITH FLARE CONTROL UNIT

[75] Inventors: Gordon H. Bahl, Jr., Northville; Roger Levy, Bloomfield Hills; Marvin J. Engelsman, Royal Oak; Jerome Kubiak, Troy, all of Mich.

[73] Assignee: Tishken Products Co., Oak Park, Mich.

[21] Appl. No.: 857,735

[22] Filed: Mar. 26, 1992

[51] Int. Cl.[5] ..... B21D 5/14

[52] U.S. Cl. ..... 72/181

[58] Field of Search ..... 72/177-179, 72/181, 249

[56] References Cited

U.S. PATENT DOCUMENTS

| | | | |
|---|---|---|---|
| 421,961 | 2/1890 | Nauman | 72/181 |
| 909,644 | 1/1909 | McCloud | 72/181 |
| 1,295,769 | 2/1919 | Kux | 72/178 |
| 1,574,397 | 2/1926 | Kirsch | 72/181 |
| 2,458,906 | 1/1949 | Himmel | 72/178 |

FOREIGN PATENT DOCUMENTS

| | | | |
|---|---|---|---|
| 149549 | 5/1937 | Austria | 72/179 |
| 256003 | 12/1927 | Italy | 72/181 |
| 61119 | 4/1985 | Japan | 72/181 |
| 522873 | 7/1976 | U.S.S.R. | 72/181 |

*Primary Examiner*—Daniel C. Crane

*Attorney, Agent, or Firm*—Dykema Gossett

[57] ABSTRACT

A unique roll forming machine is described which includes a flare control unit for removing flares at the longitudinal ends of the part. An arbor is positioned longitudinally adjacent a pair of flare rollers, and the part moves along the arbor and flare rollers. The arbor moves through an open portion of the part, and forces the ends laterally outwardly, should they be deformed laterally inwardly from a desired location. The flare rollers are positioned longitudinally adjacent the arbor, and bend the ends of the part laterally inwardly, should they be deformed laterally outwardly from a desired shaped. Several embodiments of the invention structure are disclosed.

16 Claims, 4 Drawing Sheets

ROLL FORMING MACHINE WITH FLARE CONTROL UNIT

BACKGROUND OF THE INVENTION

This application relates to controlling flares at axial ends of thin walled parts formed by roll forming machines.

In the prior art, roll forming machines having a plurality of form roll pairs are used to deform thin metal into non-planar shaped parts. A plurality of form roll pairs serially deform the metal to the desired shape.

Parts formed by the prior art roll forming machines often have downstream ends flared laterally inwardly from a desired position. Further, the upstream end of the parts are often flared laterally outwardly. Typically, it is desired that the entire part have sides which extend along a plane generally parallel to the path of travel of the part. The flaring of the ends of the parts is undesirable, as it results in waste of material, and may lead to scapping of formed parts.

Thus, it is an object of the present invention to disclose a flare control unit for removing the flare at the longitudinal ends of the formed part.

SUMMARY OF THE INVENTION

In a disclosed embodiment of the present invention, a flare control station is positioned adjacent a downstream end of a roll forming machine. The flare control station has an arbor which wedges the ends of a thin walled metal part laterally outwardly, should the ends be flared laterally inwardly. A pair of flare rollers are disposed at laterally outer locations relative to the thin walled part, and deform the ends of the part laterally inwardly, should the ends be flared laterally outwardly. The arbor and the flare rollers, in combination, ensure that the part ends are centered generally parallel to a part axis, and have the proper cross-sectional shape.

In preferred embodiments of the present invention, two pairs of flare rollers are spaced axially along the path of the workpiece, with arbor associated with each pair of flare rollers. An upstream arbor is positioned upstream of an upstream pair of flare rollers and a downstream arbor is positioned downstream of a downstream pair of flare rollers. The combination of the pairs of flare rollers and the pairs of arbors correct any flares formed in the axial ends of the part, and further serve to correct any over deformation of the part ends by the upstream arbor and flare rollers.

In further features of the present invention, the axial location of the arbors is adjustable to control the distance between the arbors and the respective pairs of flare rollers. Further, the lateral position of the flare rollers is adjustable to control the distance between outer peripheral surfaces of the flare rollers and the arbors.

The cross-sectional shape of the arbors and flare rollers may be modified to form various non-planar cross-sectional shapes.

These and other features of the present invention can be best understood from the following specification and drawings, of which the following is a brief description.

DETAILED DESCRIPTION OF A PREFERRED EMBODIMENT

Figure 1:
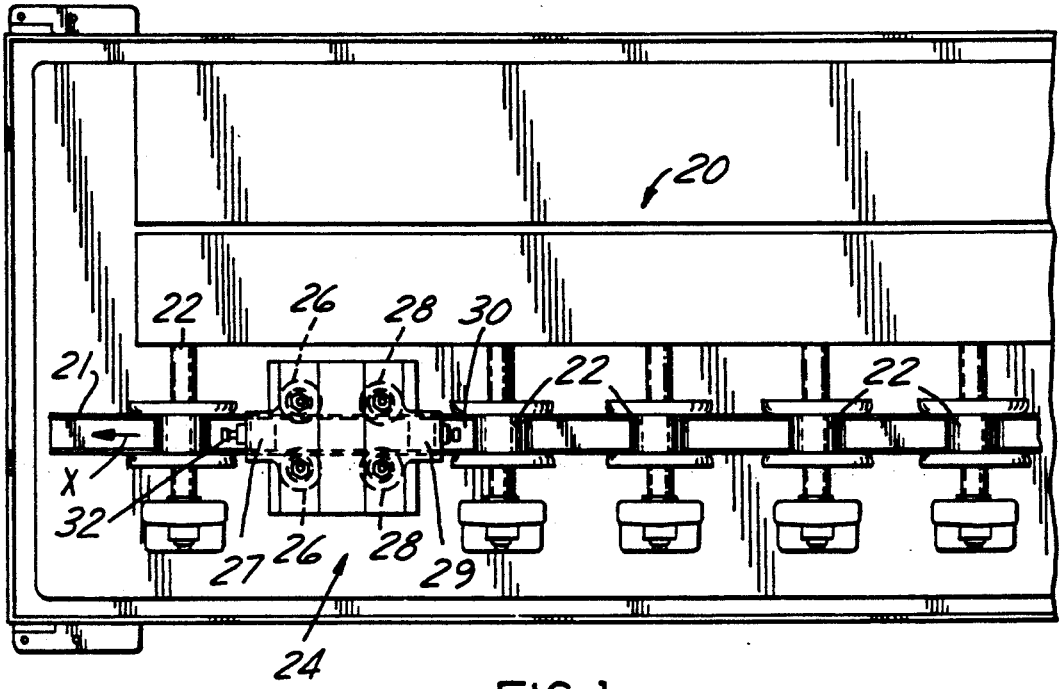
FIG. 1 is a somewhat schematic top view of a roll forming machine.

Roll forming machine 20 forms a thin walled open-ended part 21 which is open-ended and non-planar in cross-section. Part 21 moves along a part path X through a plurality of form roll pairs 22. In combination, form roll pairs 22 deform part 21 from a planar thin walled metal into the final open-ended non-planar cross-sectional shape, as shown below.

A flare control unit 24 has a downstream pair of flare rollers 26 associated with a downstream arbor 27, and an upstream pair of flare rollers 28 associated with an upstream arbor 29. As part 21 approaches a location 30 upstream of flare control unit 24 its longitudinal ends may be flared laterally inwardly or outwardly. The combination of upstream arbor 29 and flare rollers 28 deform those ends back towards a desired lateral position. Typically, it is desired that the ends extend along a plane which is generally parallel to the part path. Downstream flare rollers 26 and downstream arbor 27 ensure that the upstream flare rollers 28 and arbor 29 do not over deform the ends of part 21. Thus, as part 21 reaches downstream position 32, it has the desired non-planar cross-sectional shape.

Figure 2:
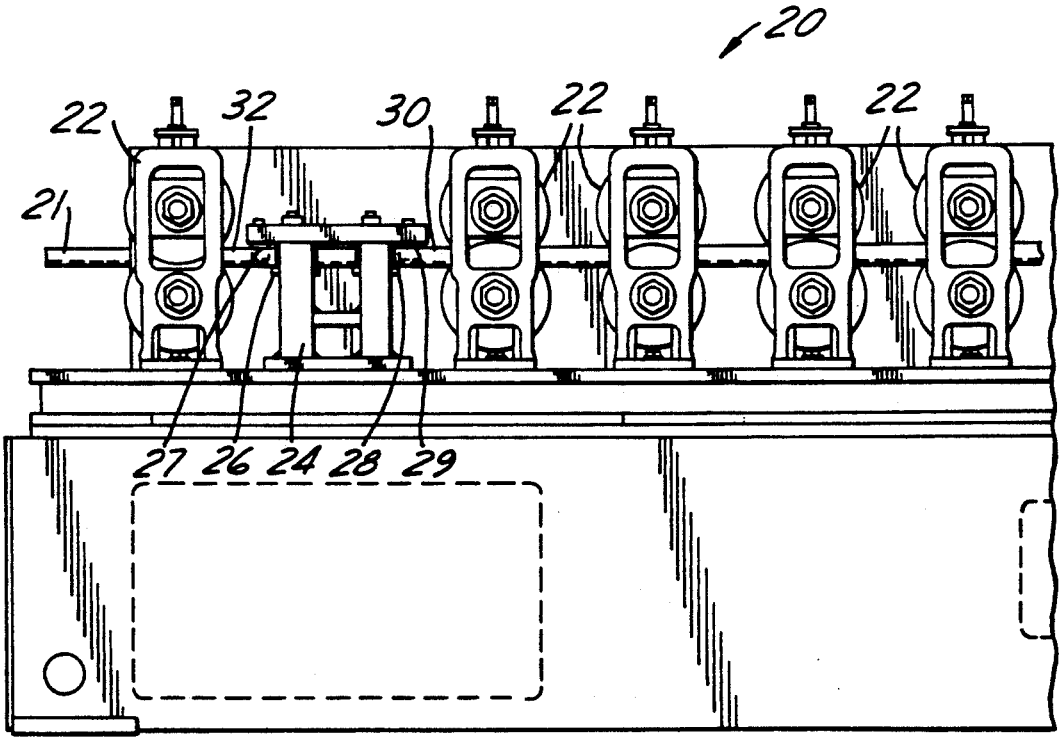
FIG. 2 is a side view of the machine shown in FIG. 1.

As shown in FIG. 2, as part 21 moves through flare control unit 24, it moves serially past upstream arbor 29, upstream flare rollers 28, downstream flare rollers 26 and downstream arbor 27. As discussed above, when part 21 reaches downstream position 32 it has a desired non-planar cross-sectional shape.

Figure 3:
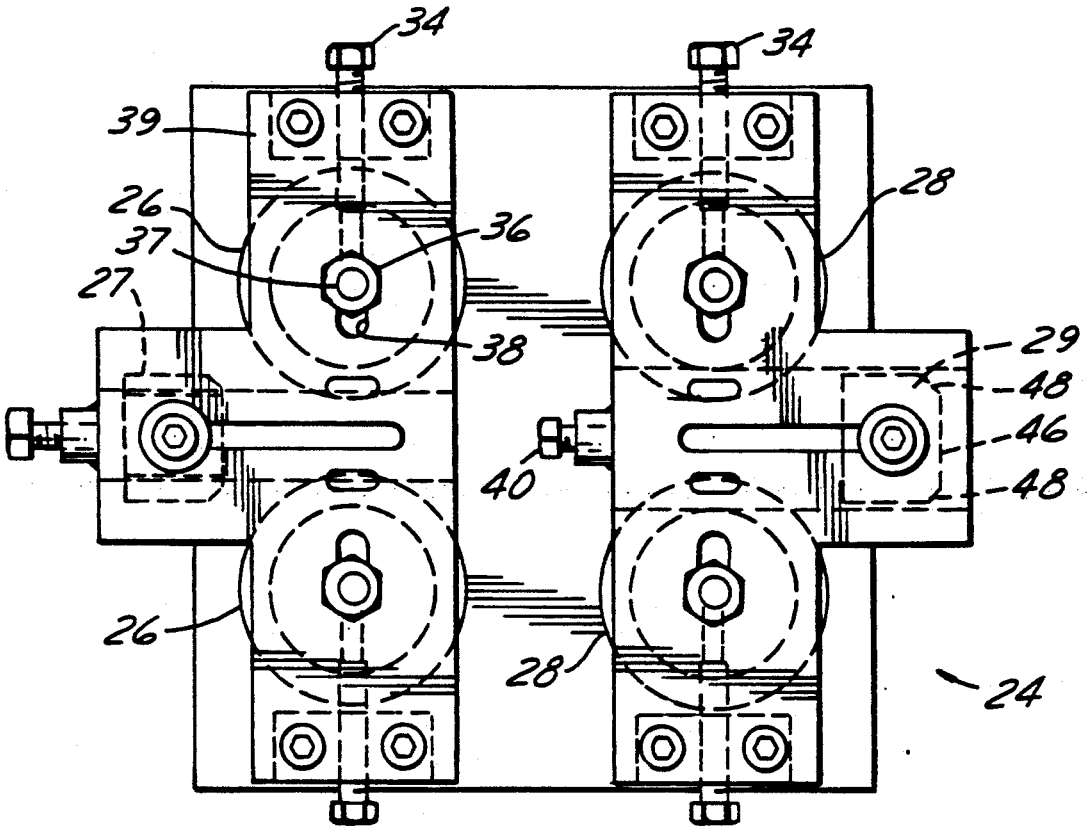
FIG. 3 is a top view of a portion of the machine shown in FIG. 1.

As shown in FIG. 3, flare control unit 24 has positioning bolts 34 which provide an adjustable stop to define the position of flare rollers 26 and 28. A sliding bolt 37 is fixed on a rotational axis for each of the flare rollers 26 and 28 by loosening nut 36, and sliding bolt 37 in a slot 38 formed in top plate 39, the lateral position of flare rollers 26 and 28 can be adjusted. Flare rollers 26 and 28 rotate relative to bolt 37, which remains fixed. Bolt 34 is also moved to define a stop which abuts bolt 37. This allows an operator to control the lateral dimension of the part leaving flare control unit 24. Further, a positioning bolt 40 abuts arbors 27 and 29 and acts in conjuction with a lock nut 42 to control movement of the arbors in slots 44. The relative position of the arbors 27 and 29, and the flare rollers 26 and 28 is controlled to control the cross-sectional shape of the formed parts.

Arbors 27 and 29 have a longitudinally forward end 46 formed with ramped portions 48 to facilitate outward deformation of the part ends. As shown, end 46 of arbor 29 is generally parallel to the lateral direction. Ramped portions 48 are spaced laterally on each side of flat end 46 and deform ends of the part laterally outwardly. Arbor 27 has substantially the same structure.

Figure 4:
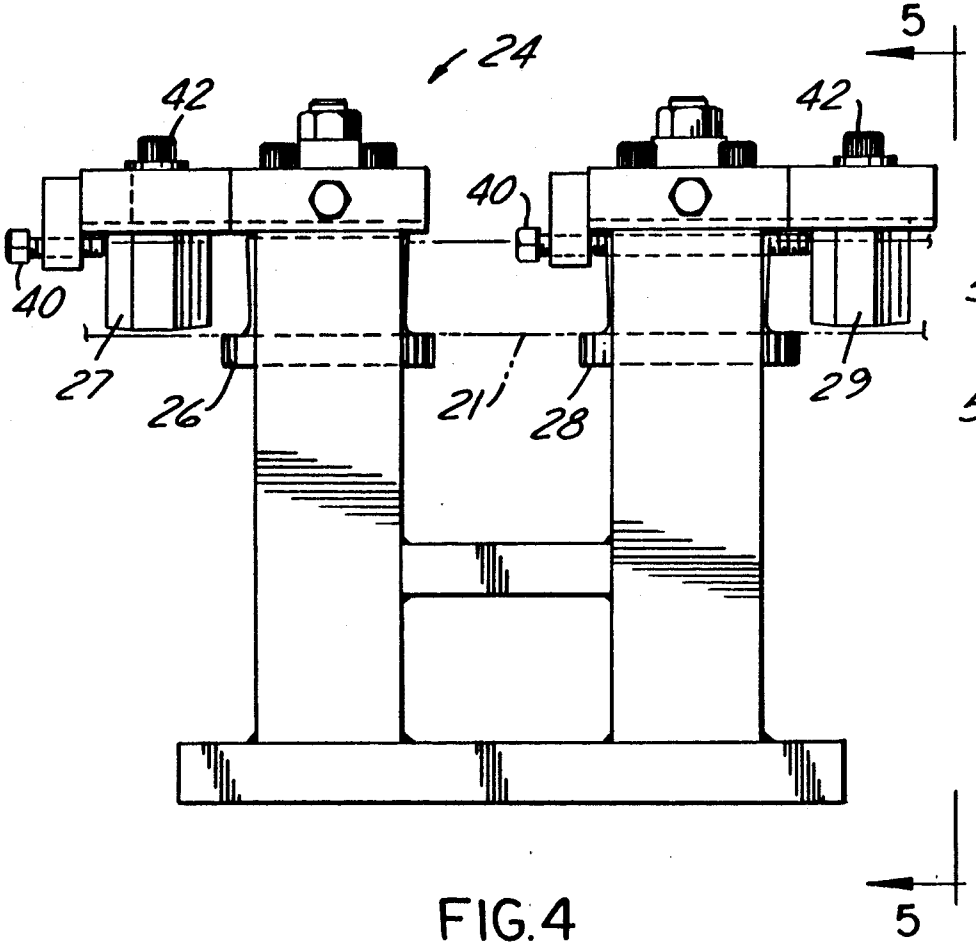
FIG. 4 is a side view of the machine portion shown in FIG. 3 parallel to the part path.

FIG. 4 shows a side view of flare control unit 24 parallel to the path of part 21. Positioning bolts 40 which abut the arbors may be adjustable to change the longitudinal position of arbors 27 and 29 relative to flare rollers 26 and 28. As shown, arbor 29 is slightly upstream of flare roller 28, while arbor 27 is slightly downstream of flare roller 26.

Figure 5:
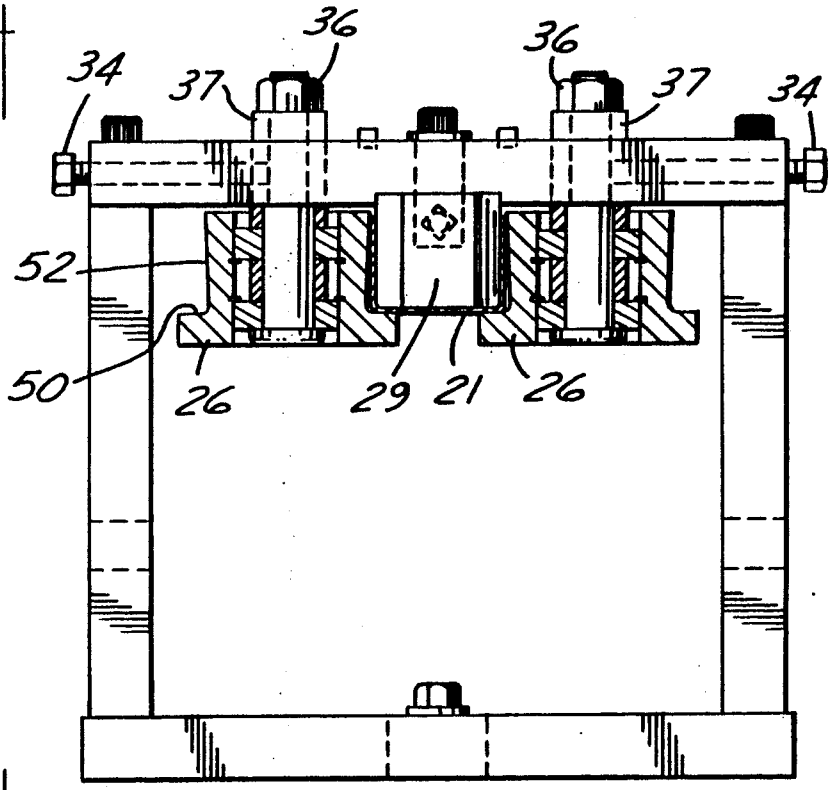
FIG. 5 is a cross-sectional view along line 5—5 as shown in FIG. 4.

FIG. 5 is a view along line 5—5 as shown in FIG. 4. As shown, part 21 is three-sided, and has an open generally U-shaped cross-section. Rollers 26 rotate about the fixed bolt 37. The outer peripheral surface of arbor 27 and rollers 26 generally conform to the cross-sectional shape of part 21. The general cross-sectional shape of part 21 is formed by the form roll pairs upstream of arbor 27. Arbor 27 and flare rollers 26 ensure that the axial ends of workpiece 21 do not flare laterally inwardly or outwardly from the desired cross-sectional shape. As further shown, positioning bolts 34 provide a stop and may be adjusted to adjust the lateral distance between rollers 26.

Further shown in FIG. 5, each roller 26 has a cylindrical upwardly facing portion 52 and a ring-shaped end face 50 which defines a small lateral gap between the laterally outer surface of arbor 27. As previously discussed, arbor 27 is positioned longitudinally upstream of rollers 26. This gap controls the shape of final part 21 and removes flares, as will be better explained below.

Figure 6:
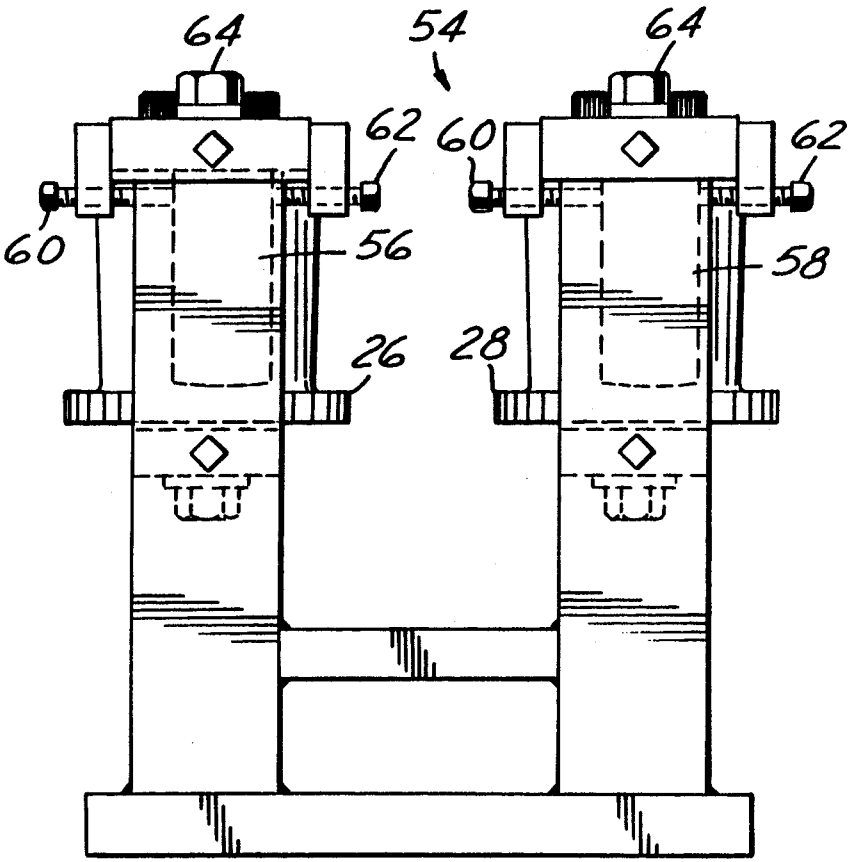
FIG. 6 is a side view of a second embodiment roll forming machine taken parallel to the part path.

FIG. 6 shows a second embodiment flare control unit 54 wherein arbor 56 is generally longitudinally aligned with flare roller 26 and arbor 58 is generally longitudinally aligned with flare roller 28. As further shown, a pair of positioning bolts 60 and 62 and nut 64 are used to allow adjustment of the longitudinal position of arbors 56 and 58.

Figure 7:
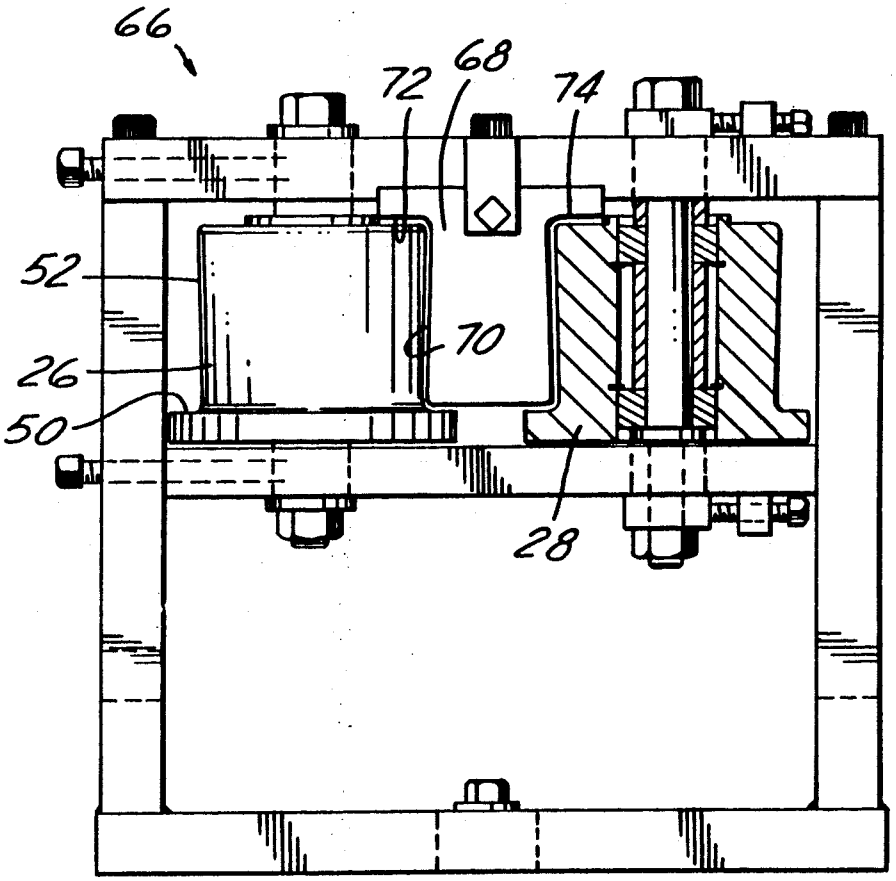
FIG. 7 is a cross-sectional view of a third embodiment roll forming machine taken perpendicular to the part path.

FIG. 7 shows a third embodiment flare control unit 66. As shown, arbor 68 has a cylindrical vertically lower portion 70 and a generally ring shaped end face 72 at a position spaced upwardly from a top face of flare rollers 26. Part 70 has a five-sided open-ended configuration with ends 74 extending laterally outwardly. The space between portion 50 and 52 of flare roller 26 and portion 70 and 72 of arbor 68 remove any flares in part 70, as will be explained below. Since the arbors are easily adjustable, it is relatively simple to remove the first embodiment arbors and substitute these second embodiment arbors.

Figure 8:
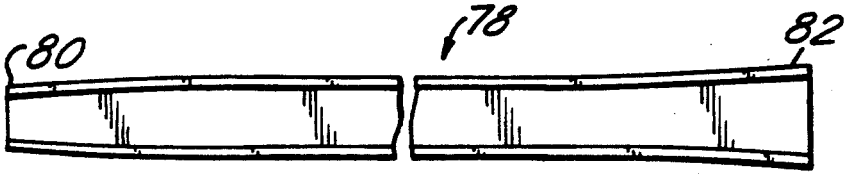
FIG. 8 illustrates a problem associated with prior art parts.

A part 78 shown in FIG. 8 has axial or longitudinal ends 80 and 82. With the typical prior art roll forming machines, the downstream end 80 often had its lateral ends deformed or flare laterally inwardly and its upstream end 82 deformed or flared laterally outwardly. This is undesirable.

Figures 9A, 9B:
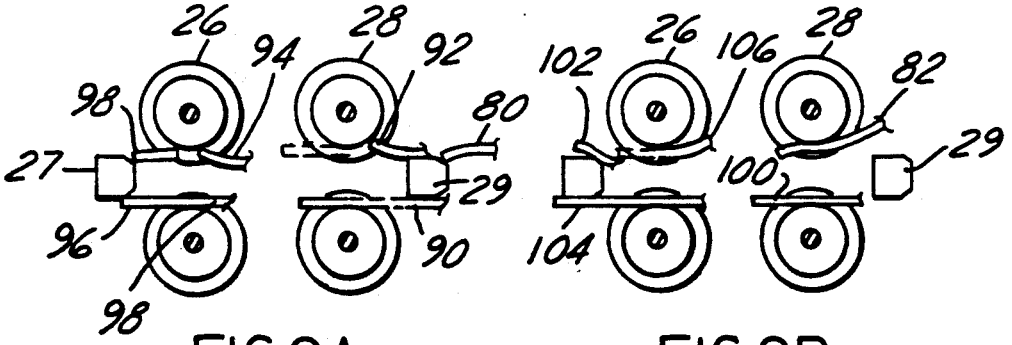
FIG. 9A illustrates a first function of the inventive flare control station.
FIG. 9B illustrates a second function of the inventive flare control station.

FIGS. 9A and 9B show the correction of the flare problem by this invention. Essentially, FIGS. 9A and 9B show the ends of part 21. The upper side of FIGS. 9A and 9B show the flare problem, while the bottom shows the corrected positions. It should be understood that the flare problem would occur at both sides, and is only shown this way for ease of illustration.

As shown in FIG. 9A, when downstream end 80 of part 78 approaches arbor 29, ramps 48 deform ends 80 laterally outwardly to a position 90 shown in phantom. If ends 80 are deformed by ramps 48 to an undesirably great amount, such as shown at 92 in phantom, flare rollers 28 deform the ends back towards position 90. Downstream flare rollers 26 and arbor 27 ensure that flare rollers 28 do not overcompensate, or over deform the ends. In particular, should the downstream end be flared laterally outwardly as shown at 94 as it approaches downstream rollers 26, downstream rollers 26 will deform the ends back towards a desired position 96. Alternatively, should the ends be deformed laterally inwardly, as shown at 98, arbor 27 will deform the ends towards the desired shape 96.

As shown in FIG. 9B, the laterally outwardly flared ends of upstream end 82 move beyond arbor 29. Flare rollers 28, however, deform the ends back towards a desired position 100, shown in phantom. If the ends are not deformed entirely by flare rollers 28, or if they are overly deformed, downstream flare rollers 26 and arbor 27 remove any remaining flares from part 78. In particular, if the upstream end is deformed laterally inwardly as shown at 102, arbor 27 will deform it towards a desired shape 104. Alternatively, should the downstream end be flared laterally outwardly, as shown at 106, downstream rollers 26 will deform the ends back towards the desired shape 104.

Preferred embodiments of the present invention have been disclosed, however, a worker of ordinary skill in the art would recognize that certain modifications would come within the scope of this invention. For that reason the following claims should be studied in order to determine the true scope and content of this invention.

We claim:

1. A roll forming machine comprising:

a plurality of form roll pairs being rotatable about first axes extending in first directions for deforming a thin metal into a desired open cross-sectional shape having inner and outer surfaces, said plurality of form roll pairs being spaced along a longitudinal work path;

at least one arbor positioned at a lateral position within said work path, and within a portion of the cross-sectional shape of the part to be formed, said arbor being shaped so as to engage only inner surfaces of said cross-sectional shape while leaving the outer surfaces of the cross-sectional shape unsupported about the entire arbor; and at least one pair of flare rollers spaced laterally outwardly of said path, and rotatable about axes which are generally perpendicular to said first directions longitudinally immediately adjacent but offset from said arbor, such that laterally innermost portions of said flare rollers are longitudinally offset from said arbor so that a line passing through axes of said pair of flare rollers does not extend through said arbor.

2. A roll forming machine as recited in claim 1, wherein said arbor has a longitudinally forward facing end which has laterally outwardly ramped lateral sides.

3. A roll forming machine as recited in claim 2, wherein said arbor has a planar surface generally perpendicular to said longitudinal work path, and said laterally outwardly ramped lateral sides extend laterally outwardly from said planar surface.

4. A roll forming machine as recited in claim 1, wherein there are a pair of said flare rollers and a pair of said arbors.

5. A roll forming machine as recited in claim 1, wherein said part has an open-ended non-planar cross section.

6. A roll forming machine as recited in claim 1, wherein said arbor has a first generally polygonal cross-sectional outer peripheral portion, and said roller has a first generally cylindrical outer peripheral portion vertically aligned with said first arbor portion, a second generally cylindrical outer peripheral portion which has a greater outer diameter than said first generally cylindrical outer peripheral portion, and spaced vertically below said first arbor portion such that the combination of the outer peripheral surfaces of said flare rollers and said arbor defines a lateral space which approximates the cross-sectional shape of the part to be formed.

7. A roll forming machine as recited in claim 6, wherein said arbor further has a second radially greater portion positioned vertically upwardly from said first arbor portion, and sais second radially greater portion defining lateral outer ends of the part to be formed.

8. A roll forming machine as recited in claim 1, wherein the longitudinal position of said arbor relative to said pair of flare rollers is adjustable.

9. A roll forming machine as recited in claim 8, wherein the lateral position of each of said pair of flare rollers being adjustable relative to said arbor.

10. A roll forming machine as recited in claim 9, wherein both of said pair of flare rollers and said arbors being adjustable by loosening a nut received on a bolt, with said bolt being slidable in a slot in a frame member.

11. A roll forming machine as recited in claim 10, wherein stop bolts are adjustable, and abut portions of said arbor and said pair of flare rollers to define a stop position for said arbor and said flare rollers after adjustment.

12. A roll forming machine as recited in claim 1, wherein the lateral position of each of said flare rollers being adjustable relative to said arbor.

13. A roll forming machine as recited in claim 1, wherein said plurality of form roll pairs rotate about an axis which is non-parallel to an axis of rotation of said pair of flare rollers.

14. A roll forming machine as recited in claim 1, wherein said arbor is positioned slightly upstream of said pair of flare rollers.

15. A roll forming machine as recited in claim 14, wherein there are a second pair of flare rollers and a second arbor located downstream of said pair of flare rollers and said arbor, said second pair of flare rollers being mounted slightly upstream of said second arbor.

16. A roll forming machine as recited in claim 1, wherein said arbor is longitudinally aligned with said pair of flare rollers.

* * * * *